United States Patent [19]

Sasaki

[11] Patent Number: 4,826,339

[45] Date of Patent: May 2, 1989

[54] DISPENSER HAVING A FLEXIBLE NIB, SLIDABLE SLEEVE AND CAP

[75] Inventor: Toshiyuki Sasaki, Tokyo, Japan

[73] Assignee: Pentel Kabushiki Kaisha, Tokyo, Japan

[21] Appl. No.: 146,685

[22] Filed: Jan. 21, 1988

[30] Foreign Application Priority Data

Feb. 6, 1987 [JP] Japan ..... 62-16465

[51] Int. Cl.[4] ..... A46B 11/00; B43K 9/00

[52] U.S. Cl. ..... 401/269; 401/117; 401/243; 401/202; 401/288

[58] Field of Search ..... 401/117, 269, 243, 247, 401/288, 202

[56] References Cited

U.S. PATENT DOCUMENTS

| | | | |
|---|---|---|---|
| 1,321,907 | 11/1919 | Graham | 401/117 |
| 1,639,388 | 8/1927 | Stebbings | 401/117 |
| 1,725,464 | 8/1929 | Lysons | 401/288 |
| 4,248,543 | 2/1981 | Carrington et al. | 401/269 X |

FOREIGN PATENT DOCUMENTS

| | | | |
|---|---|---|---|
| 307198 | 3/1929 | United Kingdom | 401/269 |

*Primary Examiner*—Steven A. Bratlie

*Attorney, Agent, or Firm*—Wenderoth, Lind & Ponack

[57] ABSTRACT

A dispenser for dispensing a suitable material comprising a tubular casing having a reduced diameter portion at its one end portion, a nib fixed to an open end of the one end portion of the tubular casing, an elongated cap for protecting the nib and a sleeve slidably mounted on the reduced diameter portion of the tubular casing. The sleeve is slidable longitudinally along the reduced diameter portion, and has a first shoulder on its outer surface. The elongated cap has an open end for fitting to the tubular casing to enclose and protect the nib, and a second shoulder on an inner surface of the open end to abut against the first shoulder when the cap is moved to fit to the tubular casing.

3 Claims, 2 Drawing Sheets

DISPENSER HAVING A FLEXIBLE NIB, SLIDABLE SLEEVE AND CAP

The present invention relates to an applicator or a dispenser of the type having a flexible nib and a cap and more particularly a cap mechanism which can cover the flexible nib without disturbing the flexible nib portions such as nibs made of a bundle of natural or synthetic fibers, or nibs made of porous materials such as sponge for discharging liquids such as cosmetics, pastes or liquid, writing ink, and powders such as cosmetic powder.

When a cap is fitted to a dispenser body, the cap usually contacts, with a friction contact, with a part or parts of the flexible nib and causes a bend, break or damage to the nib particularly when the nib is made of very soft and flexible fibers, strings, and hairs and particularly when the nib has a maximum diameter which is larger than the inner diameter of the cap. Basically, it is difficult to manually fit the cap to the dispenser body without imparting any contact or friction with the nib.

SUMMARY OF THE INVENTION

An object of the present invention is to provide a new cap mechanism for covering a nib of a dispenser.

Another object of the present invention is to provide a cap mechanism which can cover the flexible nib without imparting any damage to the nib.

According to the present invention, there is provided a dispenser for dispensing a powdery or liquid material comprising a tubular casing having a reduced diameter portion at its one end portion, a nib fixed to an open end of the one end portion of the tubular casing, and a sleeve slidably mounted on the reduced diameter portion of the tubular casing. The sleeve is slidable longitudinally along the reduced diameter portion and has a first shoulder on its outer surface. The dispenser has an elongated cap for protecting the nib. The cap has an open end for fitting to the dispenser body and a second shoulder on an inner surface so that the second shoulder is engageable with the first shoulder of the sleeve when the cap is in movement for fitting to the dispenser body.

PREFERRED EMBODIMENTS OF THE INVENTION

Figure 1:
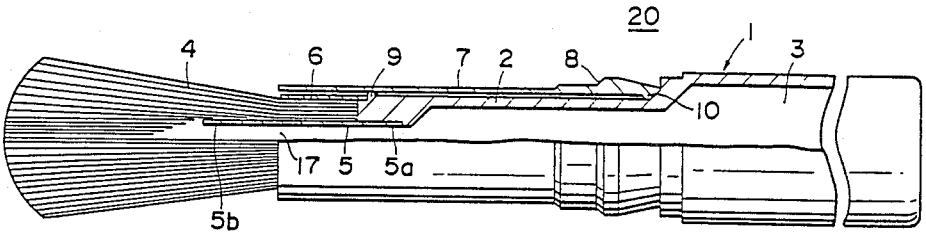
FIG. 1 is a partly sectional elevation of a dispenser embodying the present invention.
Figure 2:
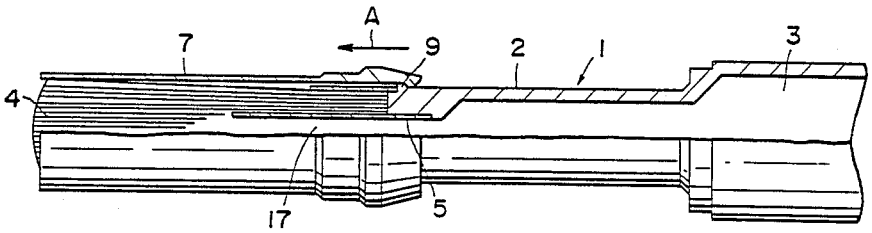
FIG. 2 is, similar to FIG. 1, a partly sectional elevation with a part being cut away, showing a state in which a sleeve is slid forward toward a nib to cover the nib.

Referring to FIGS. 1 and 2, a dispenser generally indicated by reference numeral 20 has a longitudinal, tubular casing 1 having a reduced-diameter portion 2 and a container portion 3 or reservoir for applying material such as cosmetic liquids and powder. A nib 4 is fixed to the reduced-diameter portion 2 through a connecting tube 6. In the illustrated embodiment, the nib 4 is made of a number of a natural or synthetic fibers. The tubular casing 1 has a projection 9 for preventing a sleeve 7 from being removed from the casing 1, which will be described presently. A guide tube 5 is connected at its one end 5a to the opening of the reduced-diameter portion 2 and the other end 5b extends towards and into the nib to form a passage 17 so that the material contained in the container portion 3 is smoothly directed to the nib 4. The sleeve 7 is longitudinally slidably mounted on the reduced-diameter portion 2 of the tubular casing 1, and has at its rear end an inwardly projecting projection 10 which can engage with the aforementioned projection 9 of the casing 1 when the sleeve 7 is slid along the small-diameter portion 2 toward the nib 4 as illustrated by arrow A in FIG. 2, so as to prevent the tubular casing 1 from releasing from the tubular casing 1, as illustrated in FIG. 2. The above also has a first engagement means thereon in the form of a shoulder 8 on the outer surface thereof.

Figure 3:
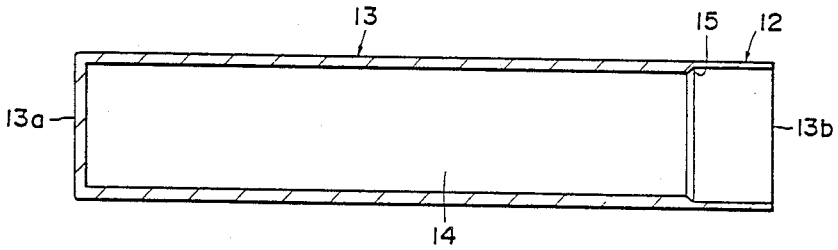
FIG. 3 is a sectional view of a cap adaptable to the dispenser body shown in FIGS. 1 and 2.

FIG. 3 shows a cylindrical cap 13 adapted to be mounted on to the dispenser body illustrated in FIGS. 1 and 2. The cap 13 has a bottom **13*a* and an engagement portion 12 having a second engagement means in the form of an engagement shoulder 15 proximal to an opening end 13*b*. The cap is long enough to have a space 14 for receiving the nib 4**.

Figure 4:
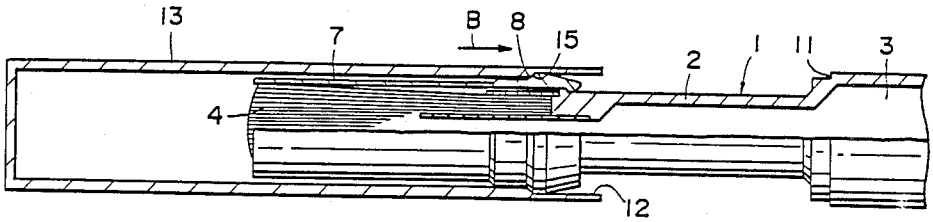
FIGS. 4 and 5 shows a fitting operation of the cap and movement of associated parts and elements.
Figure 5:
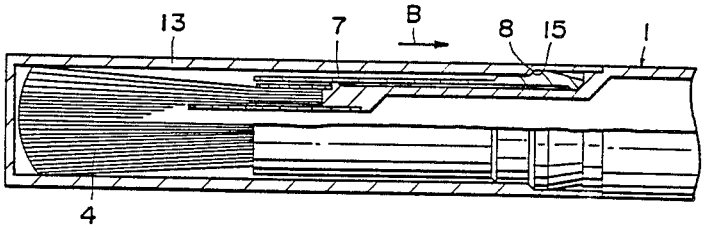
Figure 6:
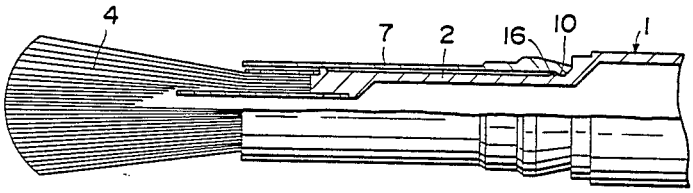
FIG. 6 is a view similar to FIG. 1 of another embodiment of the present invention.

The operation will be described with reference to FIGS. 1 through 5. The dispenser 20 is used in the state of FIG. 1 in which the sleeve 7 is retracted so that the nib 4 is exposedly projected out of the dispenser casing. When in use, the nib 4 is contacted with an object with a certain pressure, the material in the container portion 3 is discharged through the guide tube 5 and the nib 4. After use, the sleeve 7 is pushed forward to move toward the nib 4 so that the nib is longitudinally covered by the sleeve 7 with the tip end, which is spread out like an unfolded fan, being contracted as illustrated in FIG. 2. When the sleeve 7 is moved forward to the position until the projection 10 abuts against the projection 9, the normally spread tip end of the nib 4 is contracted, and then the cap 13 is fitted to the sleeve 7 in the extended position and then moved backward toward the container portion 3, as illustrated by arrows B in FIGS. 4 and 5. In this step, the cap 13 is first engaged by shoulder 15 at the shoulder 8 of the sleeve 7 as shown in FIG. 4, and then the cap 13 is moved backward along with the sleeve 7 with the engagement of the two elements 7 and 13 being maintained until the shoulder 15 abuts against a shoulder 11 so that the cap 13 is fitted in position to the tubular casing 1. Thus, in the present invention, the nib 4 is enclosed by the sleeve 7 by moving the sleeve 7 from a tightly bundled rear portion of the nib toward its spread tip portion before the cap 13 is fitted to the tubular casing 1 and, accordingly, nib 4 is not undesirably contacted with the opened end and inner surface of the cap 13. When the dispenser 20 is to be used again, the nib 4 can be immediately placed in an exposed using position by merely pulling off the cap 13 from the tubular casing 1, without the sleeve 7 moving with the cap at the time of the movement of the cap 13. Thus, the sleeve 7 is retained in the retracted position as shown in FIG. 5 when the cap is pulled off. In order to provide a reliable operation without unexpected movement of the sleeve 7 toward the nib 4 when the dispenser is in use, the reduced-diameter portion 2 of the tubular casing 1 is provided with a projection 16 (see FIG. 6) on an outer surface so that the projection 16 can resiliently engage with the projection 10 of the sleeve as illustrated in FIG. 6 when the sleeve is retracted to the rearmost position of FIG. 6.

In the illustrated embodiments of the invention, the tubular casing 1 has a suitable space 3 for the material to be discharged, but the material can be disposed on the bottom of the cap 13 if the material can be made into the form of a cake like a cosmetic powder cake, although not shown in the drawing. Further, the cap 13 can be engaged with the tubular casing by a threaded engagement rather than the press-fitting engagement in the illustrated embodiment.

According to the present invention, the nib can be covered by the sleeve by simply pressing the sleeve forwardly toward the nib regardless of the size of the maximum outer diameter of the nib before the cap is fitted to the cylindrical casing of the dispenser and, accordingly, the nib is not damaged by the fitting operation of the cap. Further, since the sleeve is retractable along with the fitting operation of the cap, the dispenser can be in the position of use in which the nib is exposed for use by merely removing the cap from the dispenser body.

Figure 7:
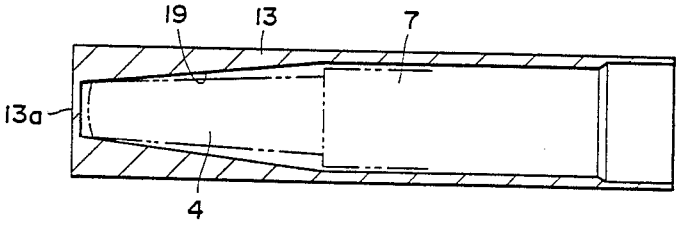
FIG. 7 is a sectional view of a cap with a modified structure according to the present invention.

If powdery material is used which is contained in the space or container portion 3(FIG. 1) in the tubular casing 1, there will be times when the powdery material is unexpectedly discharged out of the nib into the cap when an external shock is applied to the dispenser. In order to prevent the material from being unexpectedly discharged by the shock or the like, the cap may be provided with a tapered inner surface 19 which is tapering toward the bottom 13*a* as illustrated in FIG. 7 so that the nib 4, when the cap is suitably fitted in position to the dispenser body, can be contracted at its tip.

While the invention has been described in the specification and illustrated in the drawings with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention will not be limited to the particular embodiment illustrated by the drawings and described in the specification as the best mode presently comtemplated for carrying out this invention, but that the invention will include any embodiments falling within the description of the appended claims.

What is claimed is:

1. A dispenser for dispensing a suitable material comprising:

a tubular casing having an open end and a reduced diameter portion at said open end;

a nib fixed to said open end of said tubular casing;

a sleeve slidably mounted on said reduced diameter portion of said tubular casing, said sleeve being slidable longitudinally along said reduced diameter portion to a forward position where said sleeve substantially encloses said nib and to a retracted position where said nib is uncovered, said sleeve having a first engagement means on an outer surfaces thereof; and an elongated cap having an open end and fittable onto said sleeve when said sleeve is in the forward position, said cap having a second engagement means thereon abuttable against said first engagement means when said cap is fitted onto said sleeve for engaging said first engagement means to cause said sleeve to move to the retracted position and said cap to fit onto said tubular casing to enclose and protect said nib at the retracted position.

2. A dispenser as claimed in claim 1 in which said sleeve has a first projection on an inner surface of one end portion distal to said nib, and said reduced diameter portion has a second projection on an outer surface of one end proximal to said nib so that the first and second projections will abut against each other when said sleeve is moved to the forward position to thereby prevent the sleeve from being removed from the reduced diameter portion.

3. A dispenser as claimed in claim 2 in which said reduced diameter portion has a resilient projection on the outer surface thereof adjacent the full diameter portion of said tubular casing for being resiliently engaged by said first projection when said sleeve is in the retracted position for preventing said sleeve from being removed from said reduced diameter portion when said cap is removed from said sleeve, whereby said nib is automatically exposed when said cap is removed.

* * * * *